US006349663B1

(12) United States Patent
Romano

(10) Patent No.: US 6,349,663 B1
(45) Date of Patent: Feb. 26, 2002

(54) TEMPORARY STORAGE BARGE

(75) Inventor: Christian Romano, Caracas (VE)

(73) Assignee: Schlumberger Technology Corporation, Houston, TX (US)

( * ) Notice: Subject to any disclaimer, the term of this patent is extended or adjusted under 35 U.S.C. 154(b) by 0 days.

(21) Appl. No.: 09/555,234

(22) PCT Filed: Sep. 30, 1998

(86) PCT No.: PCT/EP98/06218

§ 371 Date: Jun. 26, 2000

§ 102(e) Date: Jun. 26, 2000

(87) PCT Pub. No.: WO00/18640

PCT Pub. Date: Apr. 6, 2000

(51) Int. Cl.[7] ..... B65D 88/78

(52) U.S. Cl. ..... 114/256; 114/257; 405/205; 405/210

(58) Field of Search ..... 114/256, 257; 405/205, 210

(56) References Cited

U.S. PATENT DOCUMENTS 1,176,526 A * 3/1916 Doxford ..... 114/256
3,774,563 A * 11/1973 Anderson, Sr. et al. ..... 114/256
3,779,196 A * 12/1973 Knaus et al. ..... 114/256
3,921,557 A * 11/1975 Kapteijn et al. ..... 114/256
4,019,213 A * 4/1977 Behar et al. ..... 114/256
4,127,004 A * 11/1978 Vilain ..... 405/205
4,227,477 A * 10/1980 Preus ..... 114/256
4,606,673 A * 8/1986 Daniell ..... 405/210
5,235,928 A * 8/1993 Shank, Jr. ..... 114/257

* cited by examiner

*Primary Examiner*—S. Joseph Morano
*Assistant Examiner*—Lars A. Olson
(74) *Attorney, Agent, or Firm*—John J. Ryberg; Brigitte L. Jeffery; Victor H. Segura

(57) ABSTRACT

An oil storage vessel (10) comprises a hull (12) of generally tubular form having a double wall defining one or more ballast chambers (14). The orientation of the hull (12) relative to water in which it is floated is controllable by adjusting the content of some or all of the ballast chambers (14). Thus, by suitable manipulation of the ballast chambers (14) the barge (10) may be caused to float generally horizontally, that is, with its longitudinal axis parallel to the surface of the water. In this position, it is particularly useful for transportation of the hull contents. Alternatively, the hull (12) may, be manipulation of the ballast chambers (14) be arranged with its longitudinal axis perpendicular to the surface of the water so that it can be used for collection and storage of liquids such as oil.

14 Claims, 3 Drawing Sheets

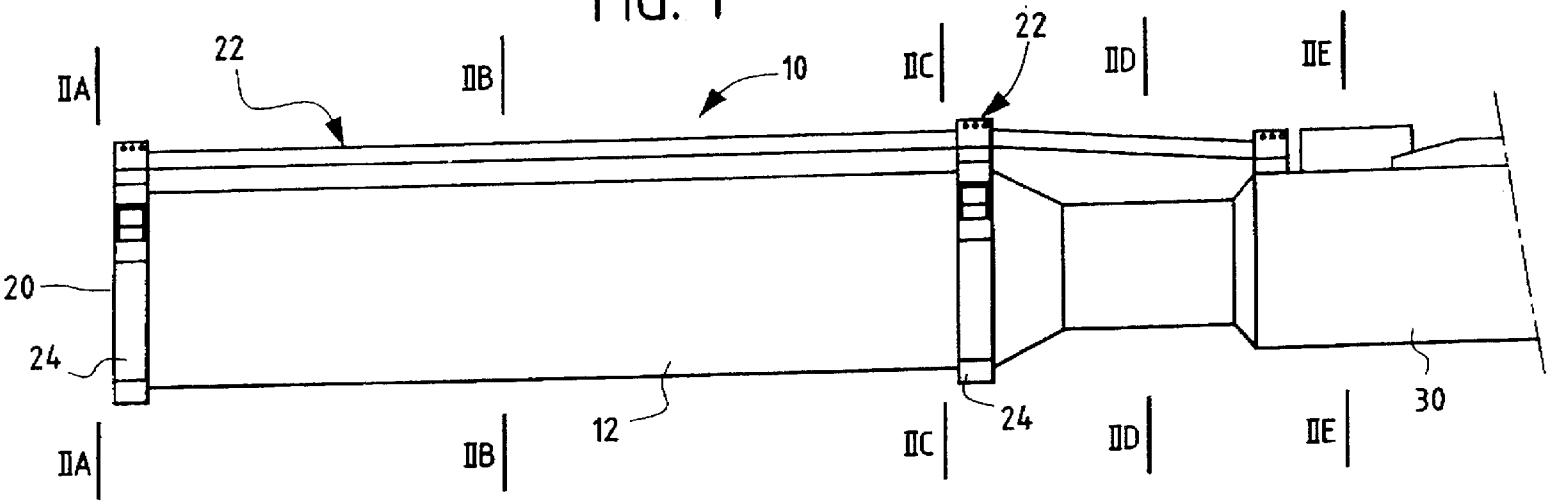
FIG. 1
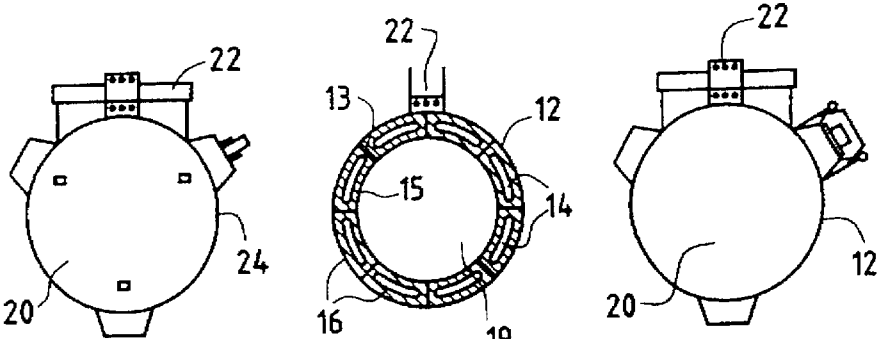
FIG.2A
FIG.2B
FIG.2C
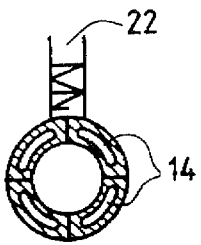
FIG.2D
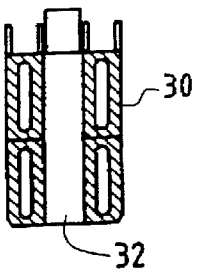
FIG.2E

TEMPORARY STORAGE BARGE

BACKGROUND OF THE INVENTION

1. Field of the invention.

The present invention relates to a barge used for temporary storage of oil. Such barges are used where oilfields are being developed or tested in marine environments.

2. Description of the Related Art

Where an oilfield is under development, a considerable volume of oil may be produced at the site of a new well before it becomes possible to export oil from the well-site by means of a pipeline or shuttle tanker. In particular, testing to determine the quality of oil being produced may be required before it is decided to proceed with a permanent or pseudo-permanent connection to pipelines.

It has been difficult, hitherto, to provide suitable temporary oil storage facilities during the initial phase of development of an oil field. It is difficult to moor or position an existing vessel or tanker close to a drilling platform if the platform is in deep water or in a harsh environment. Existing schemes have used dynamically positioned tankers or tankers with special mooring systems in shallower water (up to 120 meters) or have used modified supply boat hulls as containers to store oil on a temporary basis. This latter option, in particular, is expensive. The capital cost involved in acquiring and using such vessels is high and, since testing of oil wells is carried out on a seasonal basis, the vessels are under-utilised for at least a part of the year.

There is therefore a need for a low cost, convenient storage facility which offers temporary storage at the locations at which well testing, logging, or cleaning take place. Ideally, such storage facilities should be such that they can easily be moored in water depths from shallow (a10–15 meters) up to at least the present limit of drilling operations, say more than one thousand meters.

It is also desirable from an economic point of view that any vessel used as a temporary storage means should be classified under international regulations as an unmanned barge. In order to achieve this installations for use in ballasting, de-ballasting or oil-pumping should be carried by attendant vessels and not carried by the storage vessel itself except, perhaps, temporarily when needed. This has the additional advantage that areas which would normally be taken up by such installations are kept free.

SUMMARY OF THE INVENTION

In accordance with the invention there is provided an oil storage vessel, the vessel comprising a hull at least partially enclosing a storage chamber for containing oil and provided with a plurality of ballast chambers, the orientation of the hull relative to water in which it is floated being controllable by adjusting the content of some or all of the ballast chambers ; said hull being adapted for displacement in a horizontal orientation while the storage chamber is full, whereby said vessel is suitable for the transport of oil.

Preferably the hull is generally cylindrical in shape and is formed at least in part of a wall comprising inner and outer skins; the ballast chambers being formed in the wall of the hull between inner and outer skins thereof.

The vessel may be provided with inlet valve means for controlling the flow of material into the storage chamber and/or ballast control means for adjusting the content of the ballast chambers; the inlet valve means and/or the ballast control means being provided with means for connection to an umbilical line permit control from a remote location, for example, an attendant support vessel.

The invention can thus provide relatively inexpensive, easily maneuverable means for the temporary storage of oil which is, additionally, suitable for classification as an unmanned barge.

BRIEF DESCRIPTION OF THE DRAWINGS

An embodiment of the invention will now be described in detail, by way of example, with reference to the drawings, in which:

FIG. 1 is a schematic side view of a temporary storage and transport barge in accordance with the invention;

FIGS. 2(*a*) to (*e*) are sections through the barge of FIG. 1 taken on the lines A—A, B—B, C—C, D—D and E—E, respectively:

DETAILED DESCRIPTION OF THE INVENTION

Figure 3B:
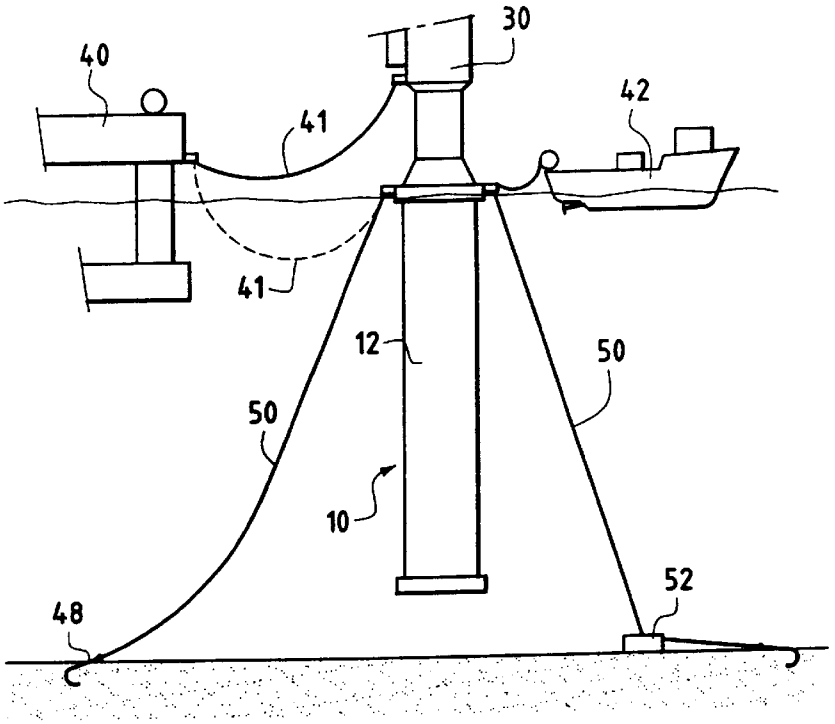
FIGS. 3(*a*) and (*b*) show two options for mooring the barge of FIG. 1 in deep water.

The temporary storage and transport barge 10 shown in the drawings comprises a main hull 12 of generally tubular form having a double wall defining one or more ballast chambers 14.

The tubular hull 12 is typically of diameter 10–20 meters and length 45–120 meters. It is formed of two concentric, watertight continuous steel shells 13,15 which are connected together by means of stiffening rings 16 and bulkheads 18 to form a pressure resistant annular void. The centre of the tubular hull 12 within the toroid is completely free of any structure and forms the main storage space 19. The ends of the tubular hull 12 may be closed off by means of stiffened ring diaphragm 20 which provide additional support for the main hull 12. The purpose of the annular void defined between the steel shells 13 and 15 is to form ballast chambers 14 by means of which the buoyancy of the whole structure can be controlled. The annular space forming the ballast chambers 14 is preferably subdivided into separate compartments so as to give better control over the buoyancy and the orientation of the barge 10 in the water. By suitable manipulation of the ballast chambers 14, the barge 10 may be caused to float generally horizontally, that is, with its longitudinal axis parallel to the surface of the water, or vertically, with its central longitudinal axis perpendicular to the surface of the water or in any other chosen orientation. By controlling the ballasting of the chambers 14 the barge 10 can be moved between these positions at will.

The ballast chambers are arranged and controlled, however, so that, when the hull 12 is floating horizontally the same line on the circumference will always be uppermost. This uppermost surface is referred to as the deck and is provided with a deck walkway 22 to permit personnel to traverse the length of the barge 10. A similar walkway may be provided on the surface which is arranged to be uppermost when the hull 12 is floating vertically.

At either end, the hull 12 is provided with a strengthening ring 24 capable of withstanding the forces necessary for mooring or anchoring the barge 10. Each ring 24 has three strong points provided with a mounting plate to which can be fitted mooring fairleads and mooring anchors for facilitating either horizontal or vertical mooring as is required at any given time. At each end of the hull 12, one, or alternatively two, of the strong points are ballasted to act as keel ballast when the barge 10 is in horizontal mode. The uppermost strongpoint(s) when the barge 10 is in horizontal mode are accessible from the ends of the deck walkway 22. The strengthening rings 24 and the central storage space in the centre of the annular hull 12 are, as mentioned above, closed off by means of stiffened ring diaphragms or bulkheads 20. These may be 'partial' pressure diaphragms or bulkheads, that is, they may be designed to withstand pressure only when the hull 12 is horizontal, allowing oil to be contained within the central storage space. When the barge 10 is aligned vertically, 'free flooding' valves may be opened to permit flooding of the central space. These valves may be operated from the deck walkway which is uppermost when the hull 12 is in a vertical orientation. Oil in the central space may be separated from seawater by containment in a flexible balloon (not shown) within the central space. Alternatively, when the hull 12 is in the vertical position, oil may simply be pumped into the upper end of the central space, displacing the seawater downwards. Overfilling of the barge 10 is avoided by monitoring the position of the oil/water interface with conventional marine monitoring apparatus close to the bottom of the hull 10.Such monitoring enables the operator to control loading.

At the bow end of the barge 10, the stiffening ring 24 acts as a foundation for several structural components. The most important of these is a ship-type bow unit 30. The bow unit 30 improves the hydrodynamics of the barge 10 when it is being towed in a horizontal orientation and, additionally, contains the equipment usually required for classification as a barge. Preferably, the bow unit 30 is provided with a central moonpool slot 32 which is free flooding so as to minimise the buoyancy of the bow unit 30. This, in turn, minimises longitudinal bending wave moments on the hull 12 and bow unit 30. The moonpool 32 may contain removable control units (not shown) used to control the barge 10.

It will be appreciated that the structure of the hull is adapted to withstand the forces acting thereon in the most demanding situation among those described above, i.e. in the transport mode, when the vessel is towed away in a horizontal orientation and the storage chamber is full of oil.

As mentioned above, it is desirable to have the vessel classified under international rules as an unmanned barge. In order to meet the requirements of the classification rules it is necessary to have the minimum systems installed on the barge itself with most control units being installed on an attendant vessel. These control units may, where appropriate, however, be installed on the barge 10 on a temporary basis.

Several different control units may be used to effect control of the barge buoyancy and ballasting in different applications, for example, horizontal towing when empty, towing when full of oil, horizontal and vertical mooring when testing. When not in use, the control units may be stored on an attendant vessel. Alternatively, the control units may be carried by an attendant vessel at all times and linked to the barge 10 when needed by an umbilical. The control unit for the vertical testing mode is, ideally, articulated when mounted on the barge 10 itself so that it remains horizontal irrespective of whether the hull 12 is in the vertical or horizontal orientation.

Figure 3A:
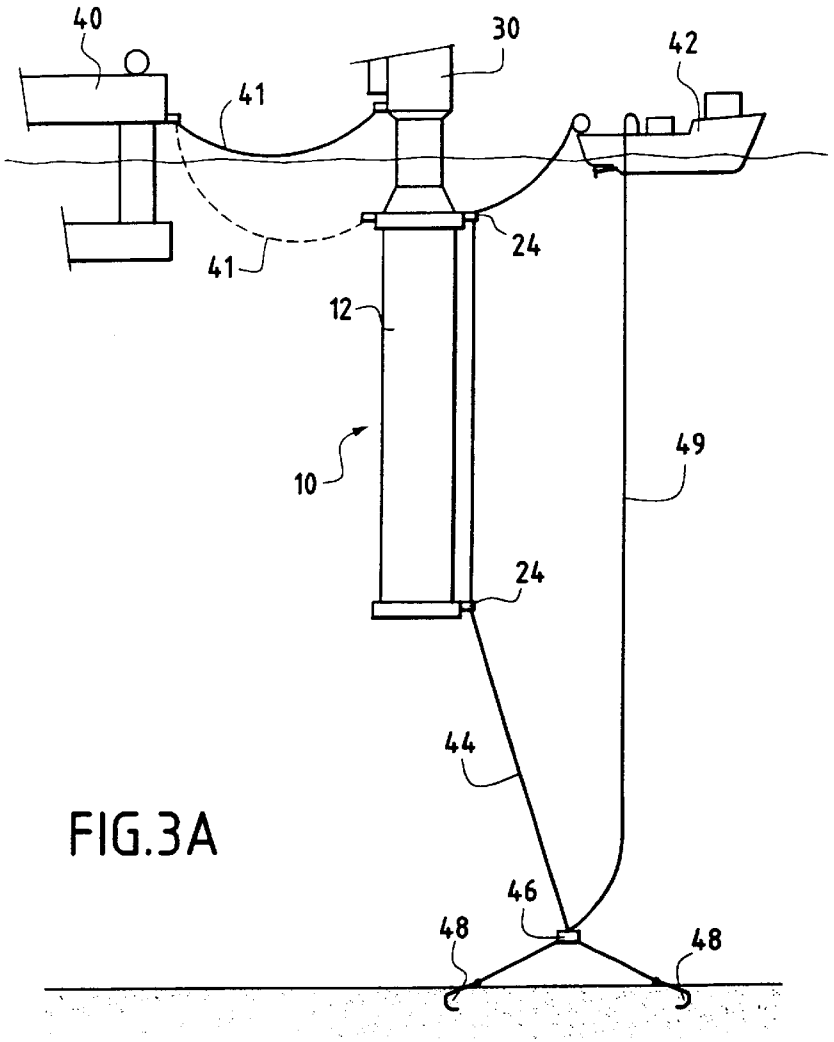
Figure 4:
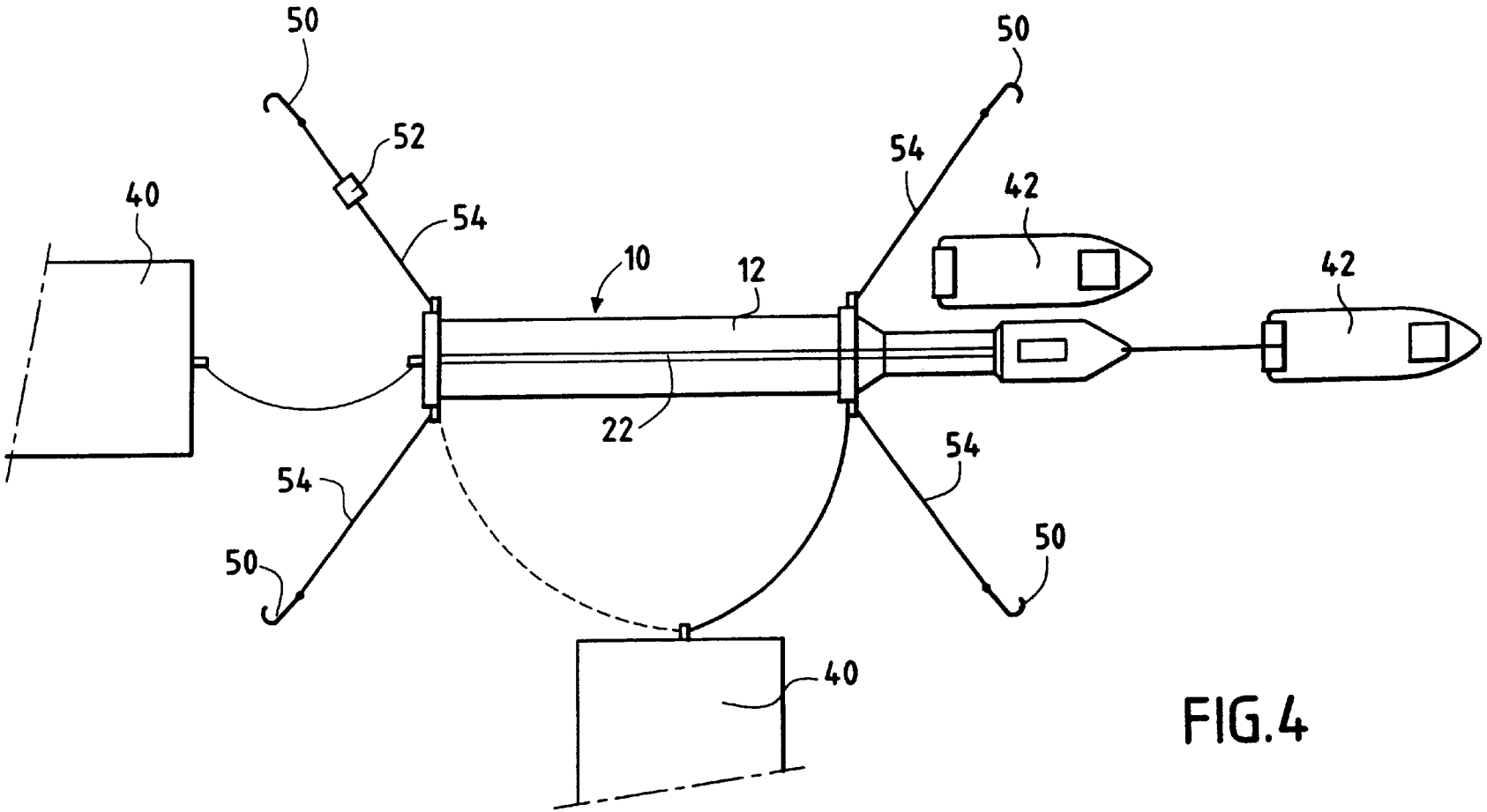
FIG. 4 shows two options for mooring the barge of FIG. 1 in shallow water.

The pressure diaphragm 20 at the bow end is designed to barge or ship classification rules to withstand the pressure head exerted by the weight of the bow structure Alternative mooring arrangements are illustrated in FIGS. 3 and 4.

In deep water the barge 10 can be deployed as shown in FIGS. 3(*a*) and (*b*), in a vertical orientation.

In each case, the barge 10 is moored of a rig 40 to which it is connected by means of a suitable transfer hose 41 and is accompanied by an attendant vessel 42 which can provide emergency towing and may also carry the control units described above for adjusting ballasting and controlling the flow of oil into the central storage chamber 19. In FIG. 3(*a*) the barge 10 is secured to the sea by means of a single fairlead 44 which passes through fixing points on both strengthening rings 24 to an anchor tensioning block 46 which is anchored to the seabed by means of anchors 48 with uplift capacity. The anchor tensioning block 46 is controlled from the attendant vessel 42 at the surface by means of release wire 49. This mooring arrangement is suitable for use in water depths greater than 150 meters.

In water depths in the range 90–150 meters the mooring arrangement of FIG. 3(*b*) is suitable. In this case, the uppermost end of the hull 12 is anchored directly to the seabed by means of either mooring anchors as indicated at 50 or anchors and clump weights 52 which serve to reduce the mooring radius.

In shallower water the barge 10 can be deployed horizontally as shown in FIG. 4. The barge 10 is positioned off the rig or platform 40 either as indicated at position 1, where the rig 40 is off to one side of the barge 10, or, as shown in position 2, with rig 40 off the stern of the barge 10.

The barge 10 is anchored by means of four lines 54 connected to suitably placed anchors 50 with or without clump weights 52. Alternatively, the two forward lines may be omitted and the position of the barge 10 maintained by a towing line to the attendant vessel 42.

What is claimed is:

1. An oil storage vessel, the vessel comprising a hull at least partially enclosing a storage chamber for containing oil and provided with a plurality of ballast chambers, the orientation of the hull relative to water in which it is floated being controllable by adjusting the content of some or all of the ballast chambers between generally horizontal in which its longitudinal axis is parallel the surface of the water and generally vertical in which its longitudinal axis is perpendicular to the surface of the water; said hull being adapted for displacement in a horizontal orientation while the storage chamber is full, whereby said vessel is suitable for the transport of oil.

2. A vessel according to claim 1 wherein the hull is formed at least in part of a wall comprising inner and outer skins; ballast chambers being formed in the wall of the hull between the inner and outer skins thereof.

3. A vessel according to claim 1 wherein the hull is generally cylindrical in shape.

4. A vessel according to claim 3 in which the hull is provided with ballasting means such as to cause the same surface of the hull to be uppermost when the hull is floating with its central cylindrical axis generally parallel to the surface of the water.

5. A vessel according to claim 3 in which the hull is provided at its ends with ring-shaped stiffening means.

6. A vessel according claim 1 wherein the hull is provided at least two points spaced from each other with means for connection to mooring lines.

7. A vessel according to claim 1 in which the hull is provided with a bow extension having a ship-type bow for facilitating towing of the vessel through water.

8. A vessel according to claim 7 in which the bow extension is provided with a moonpool slot.

9. A vessel according to claim 1 provided in the storage chamber thereof with a flexible balloon for containing the material to be stored or transport within the storage chamber.

10. A vessel according to claim 1 wherein the storage chamber is provided with inlet valve means for controlling the flow of material into the storage chamber the inlet valve means being provided with means for connection to an umbilical line to permit control thereof from a remote location.

11. A vessel according to claim 1 wherein the ballast chambers are provided with ballast control means for adjusting the content thereof, the ballast control means being provided with means for connection to an umbilical line to permit adjustment thereof from a remote location.

12. A barge for the temporary storage and/or transportation of oil being a vessel according to claim 1.

13. An oil storage vessel, the vessel comprising a hull at least partially enclosing a storage chamber for containing oil and provided with a plurality of ballast chambers, the orientation of the hull relative to water in which it is floated being controllable by adjusting the content of some or all of the ballast chambers; said hull being adapted for displacement in a horizontal orientation while the storage chamber is full, whereby said vessel is suitable for the transport of oil, the hull being provided with a bow extension having a ship-type bow for facilitating towing of the vessel through water.

14. A vessel according to claim 13 in which the bow extension is provided with a moonpool slot.

* * * * *